United States Patent [19]

Majkrzak

[11] 4,305,354

[45] Dec. 15, 1981

[54] APPARATUS AND METHOD OF HEATING COLD ENGINE

[75] Inventor: David S. Majkrzak, West Fargo, N. Dak.

[73] Assignee: Steiger Tractor Inc., Fargo, N. Dak.

[21] Appl. No.: 77,299

[22] Filed: Sep. 20, 1979

[51] Int. Cl.[3] ..... F02N 17/02

[52] U.S. Cl. ..... 123/142.5 R; 237/12.3 B

[58] Field of Search ..... 123/142.5 R; 237/12.3 B

[56] References Cited

U.S. PATENT DOCUMENTS

| | | | |
|---|---|---|---|
| 1,234,049 | 7/1917 | Lovell | 123/142.5 |
| 1,974,907 | 9/1934 | Worth | 123/142.5 R |
| 2,240,674 | 5/1941 | Seitz | 123/142.5 |
| 3,373,728 | 3/1968 | Collins | 123/142.5 R |
| 4,051,825 | 10/1977 | Elder | 123/142.5 R |
| 4,217,864 | 8/1980 | Theodore | 123/142.5 R |

OTHER PUBLICATIONS

"Motor Mate" Data, Hay-Mar Corp., Jan. '78, 24 pages.

*Primary Examiner*—Ronald B. Cox

*Attorney, Agent, or Firm*—Kinney, Lange, Braddock, Westman and Fairbairn

[57] ABSTRACT

An apparatus and method for heating a dead, cold, fluid cooled internal combustion engine which includes the use of another internal combustion engine with a cooling system having heated coolant circulated by a circulation pump and transferring the heated coolant to the cold engine cooling system. The apparatus includes three male quick couplings communicating with the cooling system and rigidly attached to each engine and a pair of coolant transfer conduits with female quick couplings at both ends. The male quick couplings are connected by the transfer for conduits and the heated coolant is transferred to the cold, dead engine and back to the hot service engine to be warmed up again. Either engine may be used as the hot service engine or can receive heated coolant from a hot service engine.

5 Claims, 3 Drawing Figures

APPARATUS AND METHOD OF HEATING COLD ENGINE

BACKGROUND OF THE INVENTION

1. Field of the Invention

The present invention relates to an apparatus and method for heating an internal combustion engine in cold weather by transferring heated coolant from the cooling system of a hot engine. In particular, the present invention relates to an apparatus or method having male quick couplings rigidly attached to and communicating with the cooling system of the engine and by using flexible conduits with female quick coupling ends transferring the heated coolant to the cold engine.

2. Description of the Prior Art

In cold weather, starting a fluid cooled, internal combustion engine sometimes requires any of various expedients such as pre-warm-up of the engine, an electrical "jump" boost, ether injection into the combustion chamber, or even pulling with another vehicle to crank the engine. The extra effort, mentioned above, in trying to start a cold engine is the result of not being able to crank the engine fast enough or to warm-up the intake air. The use of an electrical jump start, ether or pull starting can all have detrimental effects on the engine. Further, more and more new machines are being produced with automatic or power shift transmissions which do not allow pull starting. Electrical head bolt or water jacket heaters or other alternatives but are slow methods of warming an engine and require a source of electricity not always available when using a tractor in a field or a bulldozer on a job site.

The prior art has attempted to solve this problem by interconnecting cooling systems of a cold engine and a heated engine to warm up the coolant of the cold engine. The Collins U.S. Pat. No. 3,373,728 transfers heat from the heated engine to the cold engine using a heat exchanger through which the coolant of the cold engine is pumped and returned to the cold engine at a higher temperature. The drawback of this arrangement is that it requires that the hot engine or service engine be equipped with a heat exchanger.

The Elder U.S. Pat. No. 4,051,825 does not use a heat exchanger but directly mixes the coolant of the two engines. In this case, special hoses are connected to the engine block and communicate with the cooling system of the cold engine. The two hoses normally are connected together allowing coolant to circulate through them. When it is desired to connect the engine to a hot service engine, the hoses are disconnected and are connected to hoses leading from the heater hoses of the service engine. This arrangement, like the Collins patent, requires that one engine be designated as the service engine while the cold engine be equipped only to receive heated coolant from the service engine. Further, the Elder patent requires hoses to be permanently attached to the engine's cooling system thereby incurring an extra cost of hoses and undesirable water circulation, bypassing the normal circulation of water. Furthermore, Elder uses connections to the heater hoses of the hot engine. This allows too large a portion of the hot water to flow through the heater during the warm-up period, thus delaying the warm-up of the cold engine.

There is a need for a maintenance-free system that allows the coolant to be transferred efficiently from a service engine to the cold engine and provides any engine the capability of being used either as a service engine or to receive heated coolant from a service engine.

SUMMARY OF THE INVENTION

The present invention provides a versatile apparatus and method for transferring the coolant of a hot engine to a cold engine. The apparatus includes an engine with a cooling system having a heated coolant which is circulated by a circulation pump. The cold engine also has a cooling system with coolant. Both engines have male quick coupling nipples rigidly attached and communicating with their respective cooling systems. Each engine has a first male quick coupling nipple located upstream of the temperature regulator means, a second male quick coupling nipple located at a point downstream of the circulation pump towards the rear of the engine block and a third male quick coupling nipple located at the inlet of the circulation pump.

The first quick coupling nipple of the hot engine is connected to the second quick coupling nipple of the cold engine by a first fluid transfer conduit having female quick coupling ends thereby allowing heated coolant to be transferred from the hot engine to the cold engine. The first male quick coupling nipple of the cold engine is connected to the third male quick coupling nipple of the hot engine by a second fluid transfer conduit with female quick coupling ends thereby allowing the heat dissipated coolant to flow from the cold engine to the hot engine.

Each engine, being equipped with all three male quick coupling nipples can be used as either the hot engine or the cold engine. This capability is very important to a farmer or a construction contractor who has a number of vehicles, anyone of which may not start on a cold day. The farmer or construction contractor then has to only have one vehicle started, such as a passenger vehicle, to warm-up and start his heavy equipment vehicles.

DETAILED DESCRIPTION OF THE PREFERRED EMBODIMENT

Figure 1:
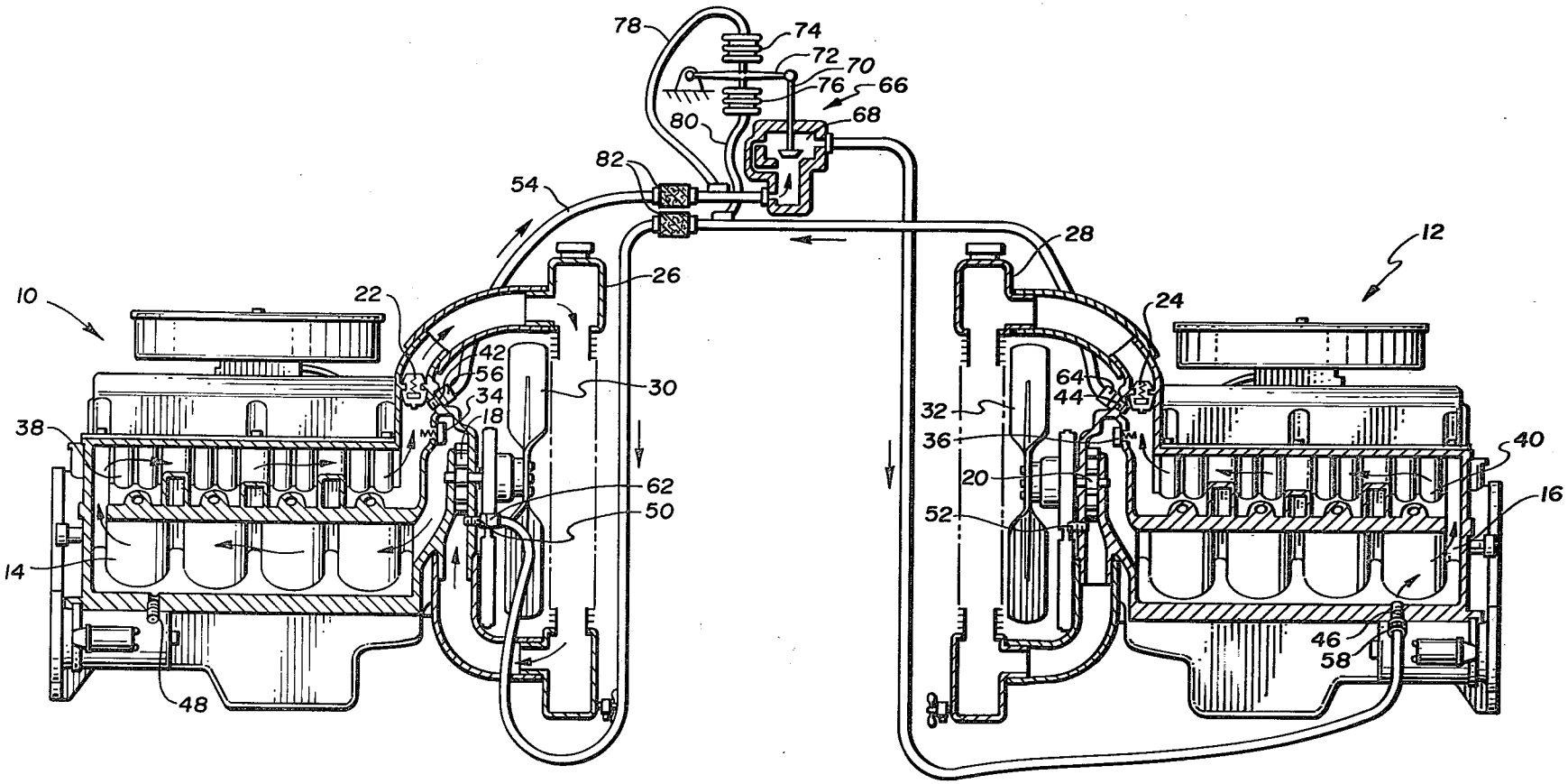
FIG. 1 is a schematic view of the present invention in operation.

FIG. 1 shows the present invention heating a cold engine 12 using coolant from a hot engine 10. The hot and cold engines 10, 12 have cooling systems 14 and 16, respectively. The cooling systems 14 and 16 include circulation pumps 18, 20 (water pumps), and temperature regulators 22, 24 (thermostats), respectively. Each cooling system has a radiator 26, 28 and radiator fan 30, 32. Bypass valves 34, 36 allow the coolant to circulate only within the engines 10, 12 when the thermostats 22, 24 close off the coolant flow to the radiators 26, 28. Each engine 10 and 12 is preferably an internal combustion engine with cylinders 38, 40.

Each engine 10 and 12 has a male nipple member 42, 44 of a quick coupling rigidly attached and communicating with the cooling systems 14, 16 slightly upstream of thermostats 22, 24, respectively. A second male quick coupling nipple member 48, 46 is rigidly attached and communicates with the cooling system 14, 16 near the rearward end of each engine. A third male quick coupling nipple member 50, 52 is rigidly attached to the intake of the water pumps 18, 20, respectively. Each male nipple quick coupling member is preferably installed in a readily available fitting in the engine.

A first fluid transfer conduit 54 with female ends 56, 58 is used to transfer coolant from heated engine 10 to cold engine 12. A second fluid transfer conduit 60 with female ends 62, 64 transfers coolant back from the cold engine 12 to the heated engine 10.

A thermal valve 66 is fixedly attached preferably to the first fluid transfer conduit 54 for controlling the flow of coolant from the heated engine 10 to the cold engine 12 to avoid any thermal shock damage to the cold engine. The valve 66 has a body 68 and a stem 70. A lever 72 is attached to the stem 70 and pivots at a point 73. A temperature sensing device 78 senses the temperature of the coolant in the fluid transfer conduit 54 and conveys a signal to bellows 74. Similarly, temperature sensing device 80 senses the temperature of the coolant in fluid transfer conduit 60 and sends a signal to bellows 76. When the temperature difference between the temperatures of the coolant in fluid transfer conduits 54 and 60 is great, the bellows 74 will expand and the bellows 76 will contract, pivoting lever 72 about pivot point 73 and pushing stem 70 downward, closing valve 66 and allowing the fluid to flow only through bypass 67. Conversely, when the temperature difference between the temperatures of the coolant in fluid transfer conduits 54 and 60 is negligible, both bellows 74, 76 will be of equal size and the lever 72 will hold stem 70 in an upward position, allowing the coolant to flow through the valve 66. For temperature differences in between the two extremes mentioned, the valve 66 will control the flow of coolant in an appropriate proportion. It should be understood that the size of the thermal valve 66 has been exaggerated for purposes of illustration. In actual practice, it would be of a size comparable with the conduits 54 and 60. Different embodiments of the valve that controls the flow of coolant by sensing a temperature differential between the coolants of the two engines are contemplated within the scope of the present invention.

A filter 82 is fixedly attached preferably to both first transfer conduit 54 and a second transfer conduit 60 to filter out any residual contaminants carried by the coolant and to prevent contamination of a clean coolant in either engine. Persons skilled in the art will understand that the filter 82 may be attached to both transfer conduits or either one, or directly to the engine cooling system with the filtering results being similar.

In use, the first transfer conduit 54 is attached to the male quick coupling nipple 42 with female quick coupling end 56. The other end of first transfer conduit 54 is attached to male quick coupling nipple 46 with female quick coupling end 58. The second fluid transfer conduit 60 is attached to male quick coupling nipple 44 with female quick coupline end 64 with the other end of the second fluid transfer conduit being attached to male quick coupling nipple 50 with female quick coupling end 62. The hot engine 10 will then be started.

When the coolant starts to flow through the first transfer conduit 54, temperature regulator 22 will respond to a closed position due to the cold coolant entering the hot engine 10 from the cold engine. In this manner, the coolant heated by engine 10 will flow into the first fluid transfer conduit 54 and to the cold engine and not into the radiator 26 using the heat produced from engine 10 efficiently. The rate of heated coolant passing through the first conduit 54 is controlled by thermal valve 66, as described previously, in order to avoid damaging the cold engine by way of a thermal shock. The heated coolant enters the cold engine 12 through male quick coupling nipple 48 at the rearward side of the cold engine, circulating through the cold engine 12 and dissipating its heat. The temperature regulator 24 is in a closed position due to the temperature of the coolant in the cold engine, preventing coolant flow into the radiator 28 and using the heated coolant more efficiently. The heat dissipated coolant leaves the cold engine 12 through male quick coupling nipple 44 located just slightly upstream of the temperature regulator 24. The position of male quick coupling nipple 48 at the opposite end of the engine from male quick coupling nipple 44 ensures that the heated coolant will flow throughout the engine cooling system. Positioning the male quick coupling nipple 48 near the front of the engine or using the male quick coupling nipple 52 at the intake of the water pump would allow the heated coolant to flow through bypass valve 36 and not distribute the heat efficiently.

The heat dissipated coolant is transferred back through conduit 60 entering the hot engine at the intake of the water pump 18 through male quick coupling nipple 50. The intake of the water pump is the starting point of circulation for the coolant in the engine and re-entry at this point allows the coolant to absorb as much heat as possible before transfer back to the cold engine 12.

The hot engine is run until the cold engine is sufficiently heated by the circulating coolant. The first and second fluid conduits are then disconnected from the male quick coupling nipples and stored away for future use. The warmed cold engine may then be started as easily as if it had been running.

As can be seen, only two of the three male quick coupling nipples are used on each engine. However, three male quick coupling nipples at the locations described provide the capability for an engine to be used as either a hot start-up engine or a cold engine capable of receiving heated coolant from another hot engine.

Figure 2:
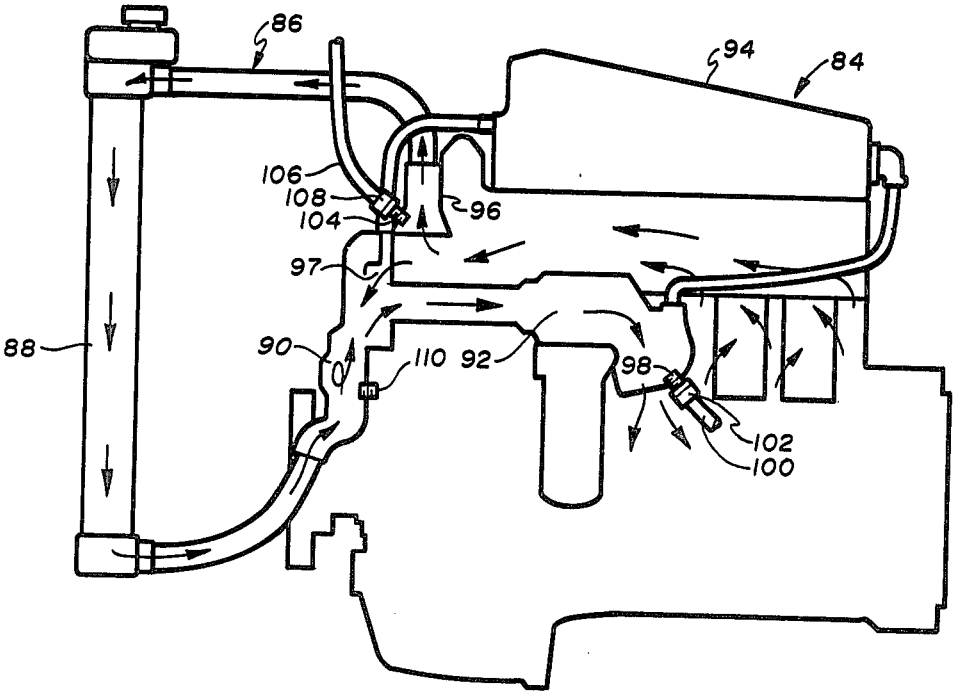
FIG. 2 is a schematic view of a diesel engine in combination with the present invention.
Figure 3:
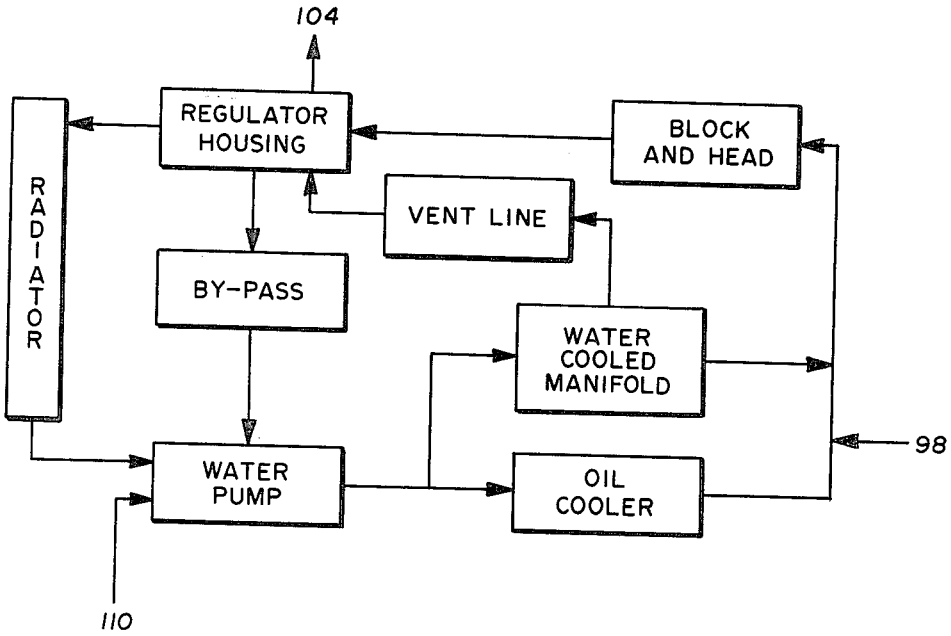
FIG. 3 is a flow diagram of the cooling system of FIG. 2.

FIG. 2 shows a schematic of a diesel engine 84 with the arrows showing the flow of coolant through the cooling system 86. FIG. 3 shows a flow diagram of the diesel engine in FIG. 2. The cooling system 86 has a radiator 88, a water pump 90, an engine oil cooler 92, a water cooled manifold 94, a water temperature regulator (thermostat) 96, and a bypass valve 97. A male quick coupling nipple 98 is rigidly attached between the oil cooler and the water cooled manifold. The position of the male quick coupling nipple 98 ensures that the heated coolant entering the engine will circulate throughout the engine before leaving the engine through a male quick coupling nipple 104. The male quick coupling nipple 104 is located slightly upstream of the temperature regulator 96, providing a return outlet for the coolant when the temperature regulator 96 is in a closed position. A third quick coupling male nipple is located at the intake of the water pump 90, providing the diesel engine 84 with the capability of transferring coolant to a cold engine. Fluid transfer conduit 100, attached to male quick coupling nipple 98 through female end 102, transfers heated coolant back to engine 84. Fluid transfer conduit 106, attached to male quick coupling nipple 104 through female end 108, returns the heat dissipated coolant.

It will be seen that conclusion apparatus has been provided for starting a cold engine from a hot engine which is interchangeable and can be quickly placed in operation. It will also be seen that when not in use, the apparatus has no effect upon normal engine operation.

Although the present invention has been described with reference to preferred embodiments, persons skilled in the art will recognize that changes may be made in form and detail without departing from the spirit and scope of the invention.

What is claimed is:

1. Apparatus for enabling a cold, fluid cooled internal combustion engine to be heated by a second hot, fluid cooled engine, each engine having a cooling system with a circulation pump with an inlet side and a temperature regulator means regulating coolant flow out of the engine, the apparatus comprising:

a first quick coupling means for each engine rigidly attached to and communicating with the cooling system of the engine slightly upstream of the temperature regulator means;

a second quick coupling means for each engine rigidly attached to and communicating with the cooling system of the engine at a point downstream of the circulation pump;

a third quick coupling means for each engine rigidly attached to and communicating with the cooling system of the engine at the inlet of the circulation pump;

a first fluid transfer conduit with quick coupling means at both ends for coupling to the first quick coupling means of the hot engine and to the second quick coupling means of the cold engine for transferring heated coolant to the cold engine cooling system; and a second fluid transfer conduit with quick coupling means at both ends for coupling to the first quick coupling means of the cold engine and to the third quick coupling means of the hot engine for transferring back the heated coolant to the hot engine and completing a closed loop system between the hot and cold engines.

2. The invention of claim 1 wherein the quick coupling means attached to the engine are male nipples projecting from the engine and the quick coupling means attached to the fluid transfer conduits are female quick coupling means.

3. The invention of claim 1 further comprising:

a flow control means for controlling the flow of the coolant between the heated engine and cold engine by sensing a temperature differential between the engines.

4. The invention of claim 1 further comprising filter means for filtering the coolant as it transfers between engines.

5. The invention of claim 4 wherein the filter means filters the coolant as it passes through the fluid transfer conduit means.

* * * * *